US009947991B2

(12) United States Patent
Murayama et al.

(10) Patent No.: US 9,947,991 B2
(45) Date of Patent: Apr. 17, 2018

(54) RADIO COMMUNICATION DEVICE

(71) Applicant: Murata Manufacturing Co., Ltd., Nagaokakyo-shi, Kyoto-fu (JP)

(72) Inventors: Hiromi Murayama, Nagaokakyo (JP); Shinichi Nakano, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 87 days.

(21) Appl. No.: 14/922,675

(22) Filed: Oct. 26, 2015

(65) Prior Publication Data

US 2016/0043461 A1 Feb. 11, 2016

Related U.S. Application Data

(63) Continuation of application No. PCT/JP2015/052147, filed on Jan. 27, 2015.

(30) Foreign Application Priority Data

Jan. 30, 2014 (JP) ..... 2014-015477

(51) Int. Cl.

| | |
|---|---|
| ***H01Q 1/24*** | (2006.01) |
| ***H01Q 1/36*** | (2006.01) |
| ***H01Q 7/00*** | (2006.01) |
| ***H01Q 13/10*** | (2006.01) |
| ***H01Q 7/06*** | (2006.01) |

(52) U.S. Cl.

CPC ..... *H01Q 1/243* (2013.01); *H01Q 1/36* (2013.01); *H01Q 7/00* (2013.01); *H01Q 7/06* (2013.01); *H01Q 13/10* (2013.01)

(58) Field of Classification Search

USPC ..... 343/702, 895, 872, 788

See application file for complete search history.

(56) References Cited

U.S. PATENT DOCUMENTS 5,825,183 A * 10/1998 Morooka ..... G01R 33/022 324/241
8,059,062 B2 * 11/2011 Orihara ..... G06K 19/07749 343/872

(Continued)

FOREIGN PATENT DOCUMENTS

JP 2009-4857 A 1/2009
JP 2010-109623 A1 5/2010

(Continued)

OTHER PUBLICATIONS

Official Communication issued in International Patent Application No. PCT/JP2015/052147, dated Mar. 31, 2015.

*Primary Examiner* — Jessica Han
*Assistant Examiner* — Hai Tran
(74) *Attorney, Agent, or Firm* — Keating & Bennett, LLP

(57) ABSTRACT

A radio communication device includes a body structural material such as a metal casing, a planar coil antenna which is disposed inside the body structural material so as to face the body structural material and includes a coil pattern and a coil opening, and a first slit pattern which is provided in the body structural material, intersects the coil pattern at at least two locations on the coil pattern in a plan view, and is not connected to an edge portion of the body structural material. Thus, mechanical strength is ensured, and predetermined communication performance is ensured.

17 Claims, 14 Drawing Sheets

(56) References Cited

U.S. PATENT DOCUMENTS

| | | | | |
|---|---|---|---|---|
| 2010/0257725 | A1* | 10/2010 | Akiho | C01G 49/0018<br>29/600 |
| 2012/0262357 | A1* | 10/2012 | Kato | H01Q 1/38<br>343/788 |
| 2013/0341411 | A1* | 12/2013 | Kai | G06K 19/07783<br>235/492 |

FOREIGN PATENT DOCUMENTS

| | | | |
|---|---|---|---|
| JP | 2012-114941 | A | 6/2012 |
| JP | 2012-164728 | A | 8/2012 |
| JP | 2012-199370 | A | 10/2012 |
| JP | 2013-162195 | A | 8/2013 |
| WO | 2011/108339 | A1 | 9/2011 |

* cited by examiner

RADIO COMMUNICATION DEVICE

BACKGROUND OF THE INVENTION

1. Field of the Invention

The present invention relates to a radio communication device preferably for use in an RFID system or a near field radio communication system.

2. Description of the Related Art

In general, a planar coil antenna is used in HF-band RFID such as NFC (Near Field Communication) implemented in a mobile terminal.

Meanwhile, a radio communication device such as a recent cellular phone terminal has been thinned. In order to deal with insufficiency of strength due to thinning, or from the standpoint of design, a resin casing is subjected to metal plating and a metal casing is used in an increasing number of applications.

However, in the case where metal is used for a casing, since a planar coil antenna included in the terminal faces a metal surface, an induced current (eddy current) flows through the metal surface so as to cancel a signal current in the planar coil. Thus, the planar coil antenna is shielded by the metal surface, thereby disabling communication with a counterpart device.

An invention regarding an antenna device for the purpose of solving the problem caused by the eddy current is disclosed in Japanese Unexamined Patent Application Publication No. 2009-4857. In the antenna device described in Japanese Unexamined Patent Application Publication No. 2009-4857, a loop antenna is disposed parallel to and near a plate conductor, and a slit is formed in the plate conductor so as to perpendicularly traverse the arc of the loop antenna.

In the antenna device described in Japanese Unexamined Patent Application Publication No. 2009-4857, although a loop-shaped mirror image current which is a mirror image with respect to an antenna current flowing through the loop antenna flows through the plate conductor, if the slit of the plate conductor is formed so as to transverse the mirror image current, the mirror image current hits an edge portion of the slit to be divided into two directions, and the divided current flows through the peripheral edge of the plate conductor in the direction opposite to the mirror image current. This is used to reduce cancellation of a magnetic field of the antenna current caused due to a magnetic field of the mirror image current.

In the antenna device shown in Japanese Unexamined Patent Application Publication No. 2009-4857, the slit is formed in the outer periphery of the plate conductor, so that a mirror image current flows along the edge of the plate conductor. Thus, the mechanical strength of the plate conductor decreases, and, for example, it is difficult to apply the structure of the above-described plate conductor to a metal casing, without decreasing the mechanical strength. In addition, when the antenna device shown in Japanese Unexamined Patent Application Publication No. 2009-4857 is applied to a metal casing of the radio communication device, great restrictions are imposed in terms of external design.

SUMMARY OF THE INVENTION

Preferred embodiments of the present invention provide a radio communication device which allows predetermined communication performance to be ensured while preventing a decrease in mechanical strength, in a structure in which a planar coil antenna faces a body structural material defined by a metal plate of the radio communication device.

A radio communication device according to a preferred embodiment of the present invention includes a body structural material (a chassis, a casing, etc.) defined by a metal plate; a planar coil antenna disposed so as to face the body structural material, the planar coil antenna including a coil pattern and a coil opening; and a first slit pattern provided in the body structural material and intersecting the coil pattern at at least two locations on the coil pattern in a plan view, the first slit pattern not being connected to an edge portion of the body structural material.

The first slit pattern preferably passes through a center of the coil opening in a plan view.

The first slit pattern preferably intersects the coil pattern at two locations on the coil pattern.

The number of the first slit patterns is preferably a plural number.

The plurality of the first slit patterns preferably divide the coil opening in a plan view.

In addition, preferably, a second slit pattern located along an outer edge of the coil pattern outside the coil pattern in a plan view is included, the second slit pattern being connected to the first slit pattern and not being connected to the edge portion of the body structural material.

According to various preferred embodiments of the present invention, since the first slit pattern intersects the coil pattern at at least two locations in a plan view, when a signal current flows through the coil antenna, a current which goes around a large circle is effectively suppressed, an induced current which cancels a magnetic field generated by the coil antenna is less likely to flow through the body structural material, and it is possible to increase the degree of coupling with an antenna of a communication counterpart. In addition, no opening which faces the coil opening of the coil antenna is provided, and the first slit pattern is not connected to the edge portion of the body structural material. Thus, the mechanical strength of the body structural material does not greatly decrease. Therefore, it is possible to configure a radio communication device which ensures a desired communication distance without greatly decreasing the mechanical strength of the body structural material.

In particular, when a second slit portion is provided along the outer edge of the coil pattern outside the coil pattern in a plan view, an induced current is more unlikely to couple between two adjacent regions separated from each other by the first slit portion, and the degree of coupling with the antenna of the communication counterpart further increases. Thus, it is possible to further increase the communication distance. Alternatively, with the small-area slit formation portion, it is possible to ensure a predetermined communication distance.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, preferred embodiments of the present invention will be described with reference to specific examples with reference to the drawings. In each drawing, the same portions are designated by the same reference signs. Each preferred embodiment is illustrative, and configurations shown in different preferred embodiments can be partially substituted or combined. In a second preferred embodiment and subsequent preferred embodiments, the description of matters common to those in a first preferred embodiment is omitted, and only the difference will be described. In particular, the advantageous effects obtained by the same configuration are not mentioned in each preferred embodiment.

First Preferred Embodiment

Figure 1A:
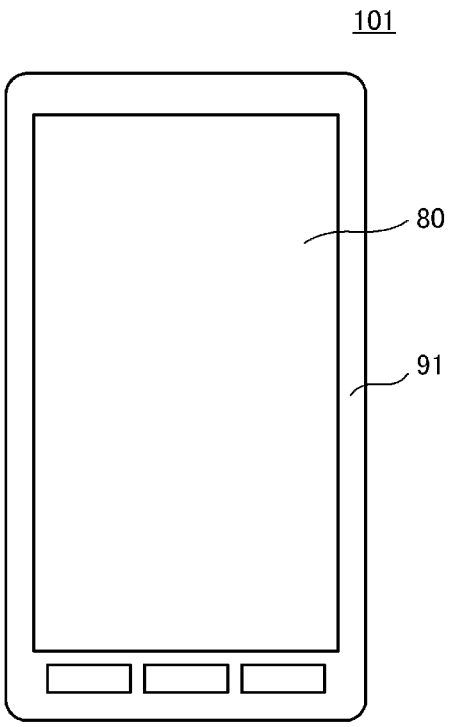
FIG. 1A is a front view of a mobile communication terminal 101 according to a first preferred embodiment of the present invention.
Figure 1B:
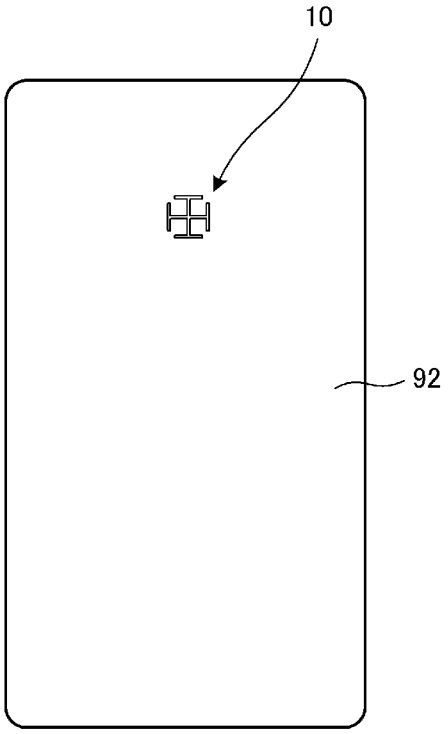
FIG. 1B is a rear view of the mobile communication terminal 101.

FIG. 1A is a front view of a mobile communication terminal 101 according to the first preferred embodiment, and FIG. 1B is a rear view of the mobile communication terminal 101. The mobile communication terminal 101 is an example of a "radio communication device". The mobile communication terminal 101 includes an upper metal casing 91 and a lower metal casing 92 define a body structural material. The mobile communication terminal 101 includes a display touch panel 80 at a front surface thereof. A planar coil antenna is disposed inside the lower metal casing 92 so as to face the lower metal casing 92. In the lower metal casing 92, a slit formation portion 10 is provided at a position facing the planar coil antenna. The slit formation portion 10 and the planar coil antenna define an antenna portion of the mobile communication terminal.

Figure 2:
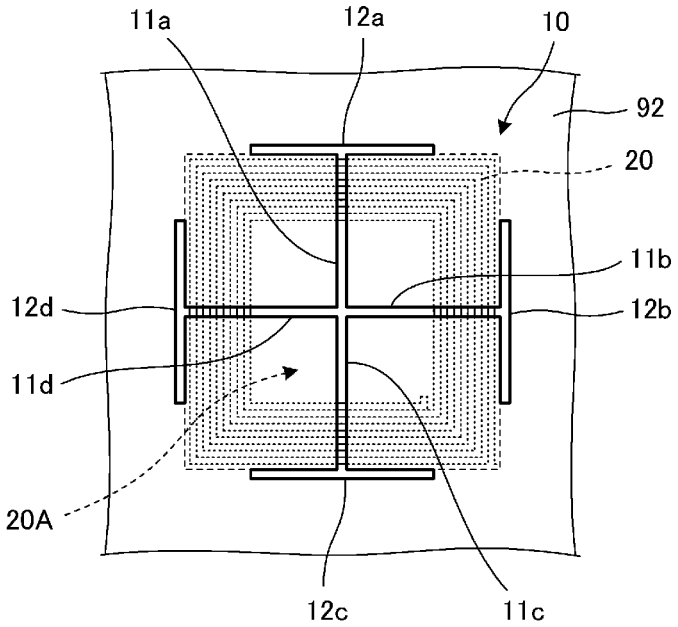
FIG. 2 is an enlarged plan view of an antenna portion.

FIG. 2 is an enlarged plan view of the antenna portion. The slit formation portion 10 includes first slit patterns 11*a*, 11*b*, 11*c*, and 11*d* and second slit patterns 12*a*, 12*b*, 12*c*, and 12*d*. The planar coil antenna includes a coil pattern 20 and a coil opening 20A. The coil pattern 20 is a rectangular or substantially rectangular spiral-shaped conductor pattern which is wound around the periphery of the coil opening 20A, and is provided on, for example, a flexible base material.

A power supply circuit and a parallel capacitor for resonant frequency adjustment are connected to both ends of the coil pattern 20. A magnetic material layer is provided at the back side of the coil opening 20A and the coil pattern 20. It should be noted that the planar coil antenna is not limited to such a form, and may be, for example, a laminate type in which a plurality of loop patterns are laminated, or one in which a magnetic material layer is inserted into a coil opening. In addition, the magnetic material layer may be provided only at the back side of the coil pattern 20, or may not be provided. It should be noted that the capacitor for resonant frequency adjustment may be connected in series to the coil pattern 20, or may not be provided.

The first slit patterns 11*a*, 11*b*, 11*c*, and 11*d* intersect the coil pattern 20 in a plan view. The first slit patterns 11*a*, 11*b*, 11*c*, and 11*d* are connected to each other at the center of the coil opening 20A.

The second slit patterns 12*a*, 12*b*, 12*c*, and 12*d* are connected to the first slit patterns 11*a*, 11*b*, 11*c*, and 11*d*, respectively, and are not connected to an edge portion of the lower metal casing 92. That is, the first slit patterns 11*a*, 11*b*, 11*c*, and 11*d* and the second slit patterns 12*a*, 12*b*, 12*c*, and 12*d* are closed in the surface of the lower metal casing 92. Each of the first slit patterns 11*a*, 11*b*, 11*c*, and 11*d* and the second slit patterns 12*a*, 12*b*, 12*c*, and 12*d* is a linear hollow portion having a uniform or substantially uniform width. The width preferably is not less than about 0.01 mm and not greater than about 1.0 mm, for example.

In FIG. 2, the coil pattern 20 preferably has an outer dimension of approximately 25×25 mm and an inner dimension of approximately 13×13 mm, for example. Line & space (L/S) preferably is about 400 μm/200 μm, and the number of turns is 10. In addition, the capacitance of the parallel capacitor preferably is set such that a resonant frequency in a state where the parallel capacitor is incorporated into the casing of the mobile communication terminal (in a state of facing the lower metal casing 92) is about 13.56 MHz, for example. From the standpoint of suppressing a decrease in mechanical strength, each of the slit widths of the first slit patterns 11*a*, 11*b*, 11*c*, and 11*d* and the second slit patterns 12*a*, 12*b*, 12*c*, and 12*d* is preferably not greater than about ⅕ of the inner diameter dimension of the coil pattern 20, and more preferably not greater than about 1/10 of the inner diameter dimension of the coil pattern 20. In the present preferred embodiment, each of the slit widths of the first slit patterns 11*a*, 11*b*, 11*c*, and 11*d* and the second slit patterns 12*a*, 12*b*, 12*c*, and 12*d* is preferably about 0.1 mm.

Each of the lengths of the first slit patterns 11*a*, 11*b*, 11*c*, and 11*d* is 12.5 mm, and each of the lengths of the second slit patterns 12*a*, 12*b*, 12*c*, and 12*d* preferably is about 12.5 mm, for example.

Figure 3A:
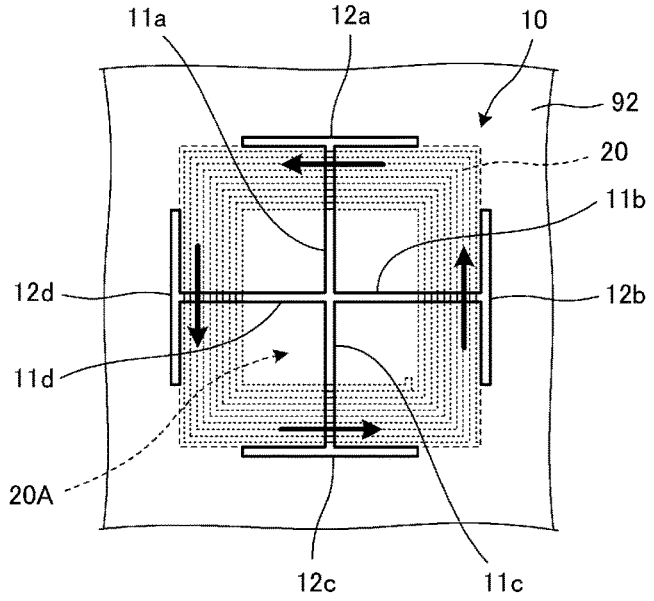
FIGS. 3A and 3B are diagrams showing a relationship between a current flowing through a coil pattern of a planar coil antenna and a current flowing through a lower metal casing 92.
Figure 3B:
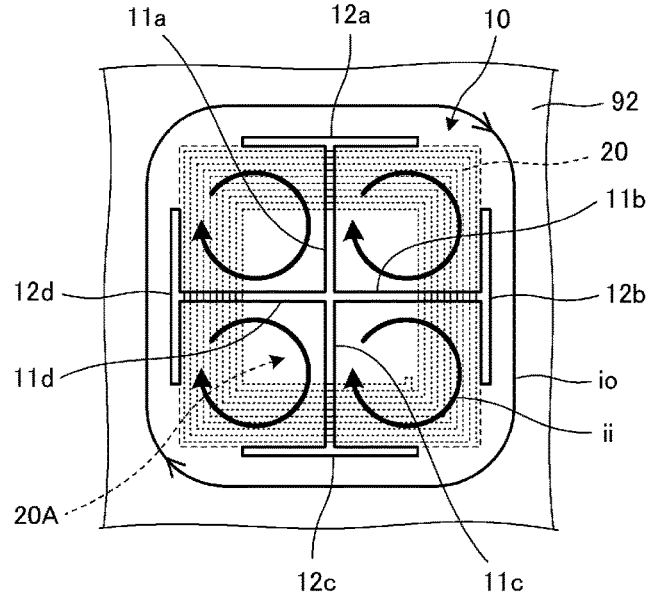

FIGS. 3A and 3B are diagrams showing a relationship between a current flowing through the coil pattern of the planar coil antenna and a current flowing through the lower metal casing 92. In FIG. 3A, arrows are an example of the direction of a signal current flowing through the coil pattern 20. In FIG. 3B, loop-shaped currents io and ii show induced currents flowing through the lower metal casing 92.

Eddy currents are induced in the lower metal casing 92 via a magnetic field generated by the current flowing through the coil pattern 20. Since the first slit patterns 11*a*, 11*b*, 11*c*, and 11*d* intersect the coil pattern at four locations in a plan view, the currents inducted in the lower metal casing 92 are shield interrupted by the first slit patterns 11*a*, 11*b*, 11*c*, and 11*d*.

As a result, an eddy current which goes around a large circle so as to have a mirror image relationship with a signal current flowing through the coil pattern 20 does not flow through the metal casing 92, and eddy currents ii which go around a small circle flow within regions demarcated by the first slit patterns 11*a*, 11*b*, 11*c*, and 11*d*.

Since the first slit patterns 11*a*, 11*b*, 11*c*, and 11*d* demarcate the ranges within which the eddy currents flow as described above, the directions of the adjacent eddy currents ii which go around a small circle are opposite to each other, magnetic fields generated by the eddy currents are cancelled near the center of the coil opening 20A (near the first slit patterns 11*a*, 11*b*, 11*c*, and 11*d*). Since the eddy currents which flow in the respective segments are effectively cancelled at the portion where the segments are adjacent to each other, the first slit patterns 11*a*, 11*b*, 11*c*, and 11*d* are preferably configured to pass through the center of the coil opening 20A to equally divide the coil opening 20A in a plan view.

In addition, in order that the first slit patterns 11*a*, 11*b*, 11*c*, and 11*d* demarcate the ranges within which the eddy currents flow as described above, the first slit pattern preferably intersects the coil pattern 20 at at least two locations on the coil pattern 20. Moreover, in order to demarcate many ranges within which eddy currents flow, a plurality of first slit patterns are preferably provided.

The second slit patterns 12*a*, 12*b*, 12*c*, and 12*d* suppress and significantly reduce the ranges within which the currents ii go around. In addition, the second slit patterns 12*a*, 12*b*, 12*c*, and 12*d* are preferably provided at the same positions or at substantially the same positions as the outer edge of the coil pattern 20, or at slightly outer side portions of the outer edge of the coil pattern 20, and thus the second slit patterns 12*a*, 12*b*, 12*c*, and 12*d* suppress an eddy current io which tends to go around the slit formation portion 10, that is, eddy currents which tend to flow within the regions demarcated by the first slit patterns 11*a*, 11*b*, 11*c*, and 11*d*.

Therefore, a magnetic field generated by the planar coil antenna is less likely to be cancelled by the eddy currents, and the magnetic field of the planar coil antenna equivalently passes through the lower metal casing 92 and couples with an antenna of a communication counterpart.

Figure 4A:
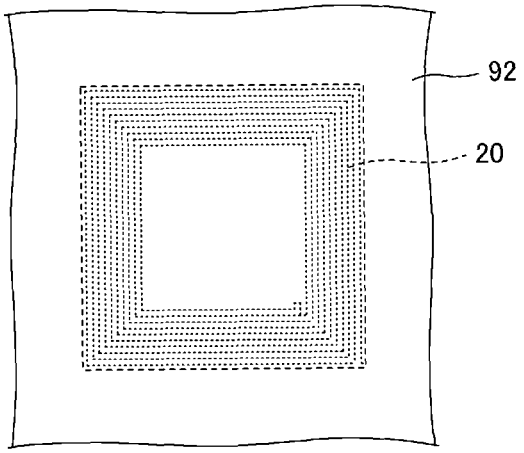
FIGS. 4A, 4B, and 4C are each a plan view of an antenna portion of a mobile communication terminal as a comparative example for comparison to the first preferred embodiment of the present invention.
Figure 4B:
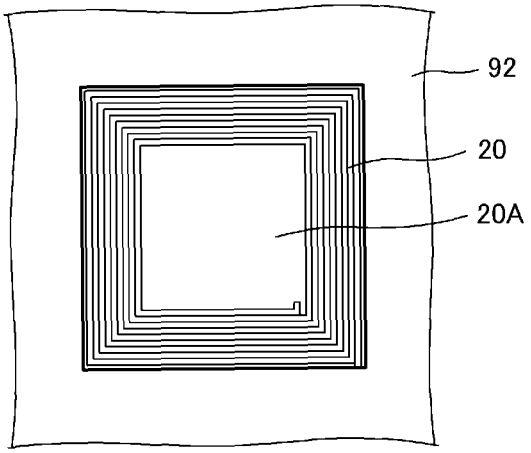
Figure 4C:
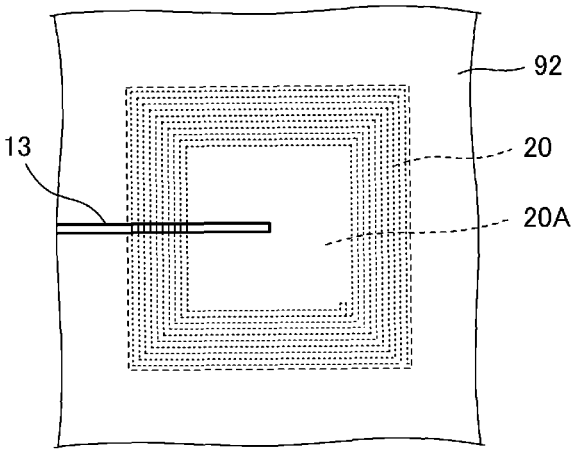

FIGS. 4A, 4B, and 4C are each a plan view of an antenna portion of a mobile communication terminal as a comparative example for the first preferred embodiment of the present invention. FIG. 4A shows an example where no opening and no slit are provided in the lower metal casing 92, FIG. 4B shows an example where an opening is provided at a position on the lower metal casing 92 that faces the planar coil antenna, and FIG. 4C shows an example where one slit pattern 13 is provided in the lower metal casing 92 so as to extend in the radial direction from the center of the coil opening 20A of the planar coil antenna. The configuration of each planar coil antenna is preferably the same or substantially the same as shown in FIG. 2.

Figure 5:
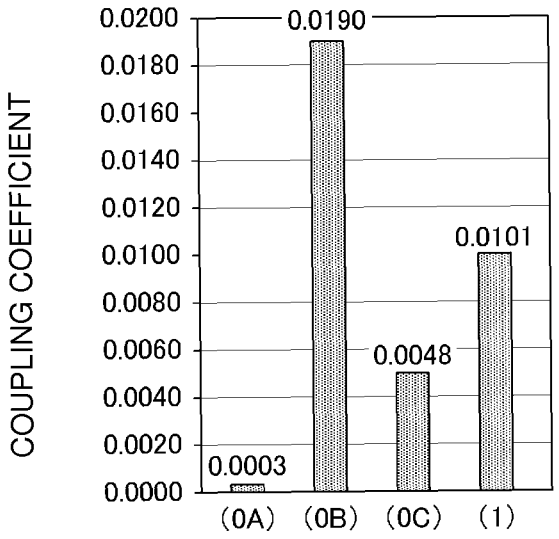
FIG. 5 is a diagram showing characteristics of the antenna portion of the first preferred embodiment of the present invention shown in FIG. 2 and the antenna portions of the comparative examples shown in FIGS. 4A, 4B, and 4C.

FIG. 5 is a diagram showing characteristics of the antenna portion of the first preferred embodiment shown in FIG. 2 and the antenna portions of the comparative examples shown in FIGS. 4A, 4B, and 4C. In FIG. 5, the vertical axis indicates a coupling coefficient with an antenna at a communication counterpart side. The antenna at the communication counterpart side preferably is a loop antenna with a diameter of about 70 mm for a reader/writer, for example. The distance between the antennas preferably is about 25 mm, for example.

In FIG. 5, (0A), (0B), and (0C) are the characteristics of the respective antenna portions shown in FIGS. 4A, 4B, and 4C, and (1) is the characteristics of the antenna portion of the first preferred embodiment shown in FIG. 2. If no opening and no slit are provided in the lower metal casing 92 as shown in FIG. 4A, the coupling coefficient is about 0.0003 which is very low, and the antenna portion does not function as an antenna. If an opening is provided in the lower metal casing 92 at the position facing the planar coil antenna as shown in FIG. 4B, the coupling coefficient is about 0.019, and the antenna portion strongly couples with the antenna at the communication counterpart side. If one slit 13 is provided in the lower metal casing 92 at the position facing the planar coil antenna as shown in FIG. 4C, the coupling coefficient is about 0.0048, and the antenna portion slightly couples with the antenna at the communication counterpart side. The antenna portion according to the first preferred embodiment shown in FIG. 2 has a coupling coefficient of about 0.0101 and sufficiently couples with the antenna at the communication counterpart side.

According to the present preferred embodiment, although the total area of the slits in the slit formation portion 10 is very small as compared to the area of the opening shown in FIG. 4B, a relatively high coupling coefficient is obtained. In addition, no opening which faces the coil opening of the coil antenna is provided, and the first slit patterns are not connected to the edge portion of the body structural material. Thus, the mechanical strength of the body structural material is not greatly decreased, or the design of the body structural material is not greatly impaired. Furthermore, merely the slit having a width of about 0.1 mm is provided in the metal casing, thus it is difficult to visually recognize the slit in a normal use state, and no great restrictions are imposed in terms of external design.

Second Preferred Embodiment

In a second preferred embodiment of the present invention, a difference in characteristics due to a difference in the number of first slit patterns of the slit formation portion will be described.

Figure 6A:
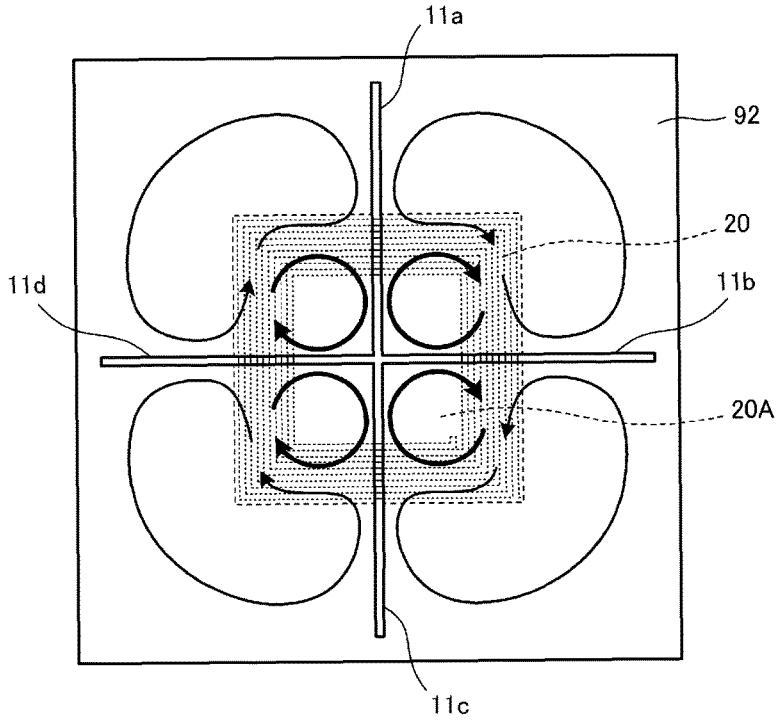
FIGS. 6A and 6B are each a plan view of an antenna portion of a mobile communication terminal according to a second preferred embodiment of the present invention.
Figure 6B:
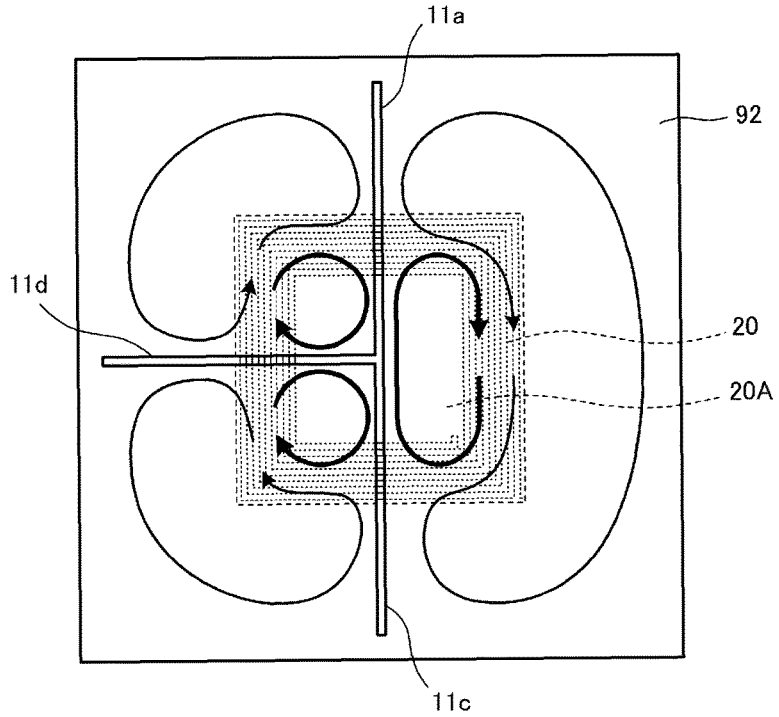

FIGS. 6A and 6B are each a plan view of an antenna portion of a mobile communication terminal according to the second preferred embodiment. In FIG. 6A, the slit formation portion includes first slit patterns 11*a*, 11*b*, 11*c*, and 11*d*. In FIG. 6B, the slit formation portion includes first slit patterns 11*a*, 11*c*, and 11*d*. Each of the lengths of the first slit patterns 11*a*, 11*b*, 11*c*, and 11*d* preferably is about 22.5 mm, for example. Either planar coil antenna includes a coil pattern 20 and a coil opening 20A. The configuration of each planar coil antenna preferably is the same or substantially the same as shown in the first preferred embodiment.

Figure 7:
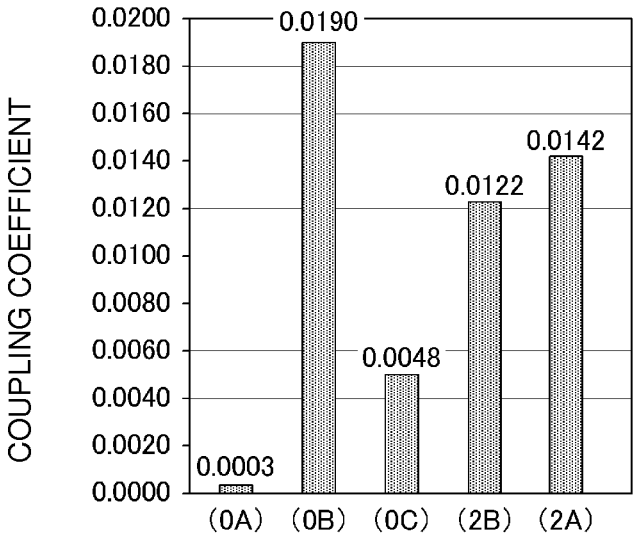
FIG. 7 is a diagram showing characteristics of the antenna portions of the second preferred embodiment shown in FIGS. 6A and 6B and the antenna portions of the comparative examples shown in FIGS. 4A, 4B, and 4C.

FIG. 7 is a diagram showing characteristics of the antenna portions of the second preferred embodiment shown in FIGS. 6A and 6B and the antenna portions of the comparative examples shown in FIGS. 4A, 4B, and 4C. In FIG. 7, the vertical axis indicates a coupling coefficient with the antenna at the communication counterpart side. The conditions for measurement are the same as shown in the first preferred embodiment.

In FIG. 7, (0A), (0B), and (0C) are the characteristics of the respective antenna portions shown in FIGS. 4A, 4B, and 4C, and (2A) and (2B) are the characteristics of the antenna portions of the second preferred embodiment shown in FIGS. 6A and 6B. If four first slit patterns are arranged to define a cross shape in the lower metal casing 92 at the position facing the planar coil antenna as shown in FIG. 6A, the coupling coefficient is about 0.0142, and the antenna portion strongly couples with the antenna at the communication counterpart side. Even if three first slit patterns are arranged to define a T shape in the lower metal casing 92 at the position facing the planar coil antenna as shown in FIG. 6B, the coupling coefficient is about 0.0122, and the antenna portion strongly couples with the antenna at the communication counterpart side.

Third Preferred Embodiment

In a third preferred embodiment of the present invention, a difference in characteristics due to a difference in the shape of the first slit patterns of the slit formation portion will be described.

Figure 8A:
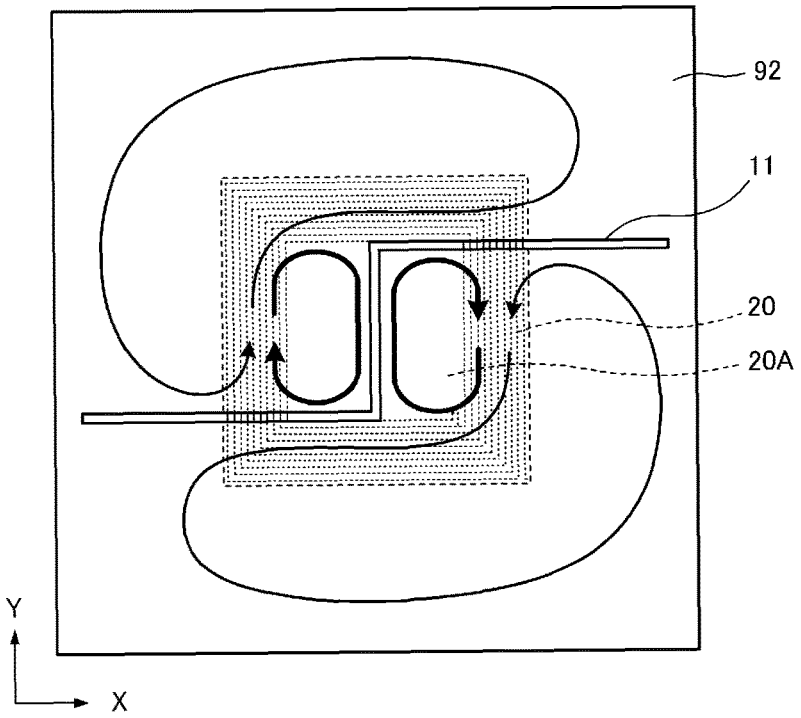
FIGS. 8A and 8B are each a plan view of an antenna portion of a mobile communication terminal according to a third preferred embodiment of the present invention.
Figure 8B:
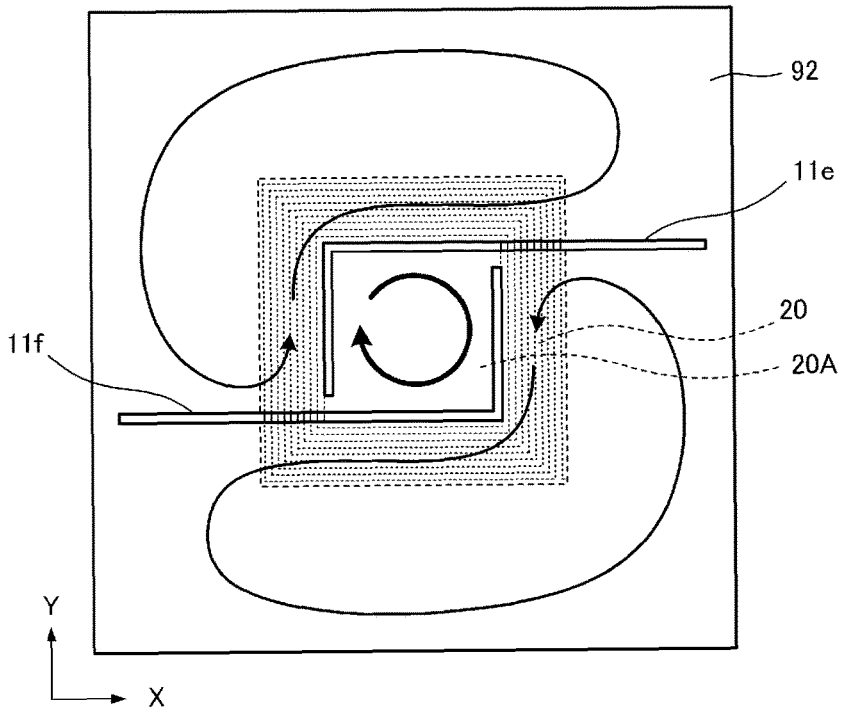

FIGS. 8A and 8B are each a plan view of an antenna portion of a mobile communication terminal according to the third preferred embodiment. In FIG. 8A, the slit formation portion includes one first slit pattern 11. Of the first slit pattern 11, the length of a portion extending in a Y-axis direction preferably is about 13 mm, and the length of each portion extending in an X-axis direction preferably is about 22.5 mm, for example. Even if the number of first slit patterns 11 is one as described above, when the first slit pattern 11 is configured to pass through the center of the coil opening 20A and intersect the coil pattern 20 at two locations, eddy currents which go around a small circle in the same direction are adjacent to each other. In addition, the first slit pattern projects outside the coil pattern 20, and thus an eddy current which tends to go around the slit formation portion is also suppressed.

In FIG. 8B, the slit formation portion includes two L-shaped first slit patterns 11*e* and 11*f*. Each of the lengths of the first slit patterns 11*e* and 11*f* in the X-axis direction preferably is about 37.5 mm, and each of the lengths of the first slit patterns 11*e* and 11*f* in the Y-axis direction preferably is about 12 mm, for example. Even if the first slit patterns do not pass near the center of the coil opening 20A as described above, a current that goes around inside the first slit patterns 11*e* and 11*f* (inside the coil opening 20A) flows along the first slit patterns 11*e* and 11*f*, so that currents that go around along outer side portions of the first slit patterns 11*e* and 11*f*, respectively, flow. In addition, the first slit patterns 11*e* and 11*f* project outside the coil pattern 20, and thus an eddy current that tends to go around the slit formation portion is also suppressed.

Figure 9:
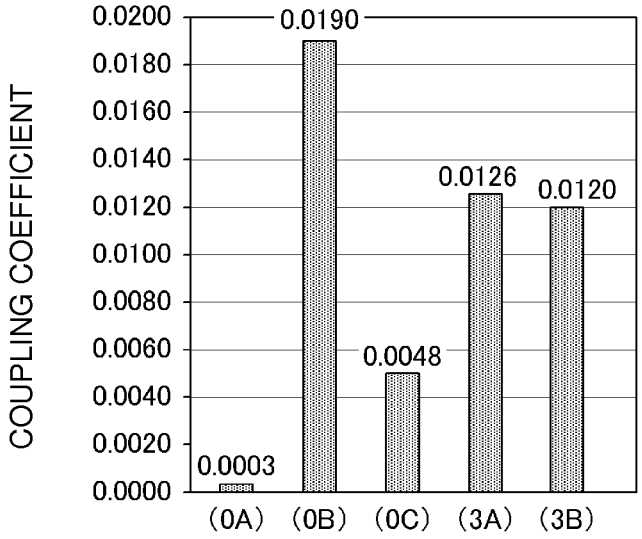
FIG. 9 is a diagram showing characteristics of the antenna portions of the third preferred embodiment of the present invention shown in FIGS. 8A and 8B and the antenna portions of the comparative examples shown in FIG. 4.

FIG. 9 is a diagram showing characteristics of the antenna portions of the third preferred embodiment shown in FIGS. 8A and 8B and the antenna portions of the comparative examples shown in FIGS. 4A, 4B, and 4C. In FIG. 9, the vertical axis indicates a coupling coefficient with the antenna at the communication counterpart side. The conditions for measurement are the same as shown in the first preferred embodiment.

In FIG. 9, (0A), (0B), and (0C) are the characteristics of the respective antenna portions shown in FIGS. 4A, 4B, and 4C, and (3A) and (3B) are the characteristics of the antenna portions of the third preferred embodiment shown in FIGS. 8A and 8B. Even if the number of the first slit patterns 11 is one as shown in FIG. 8A, when the first slit pattern 11 intersects the coil pattern at two locations, a coupling coefficient of about 0.0126 which is high is obtained. In addition, even if the first slit patterns do not pass near the center of the coil opening 20A as shown in FIG. 8B, when the first slit patterns extend outside the coil pattern 20, a coupling coefficient of about 0.012 which is high is obtained.

Fourth Preferred Embodiment

In a fourth preferred embodiment of the present invention, advantageous effects obtained by second slit patterns of the slit formation portion will be described.

Figure 10A:
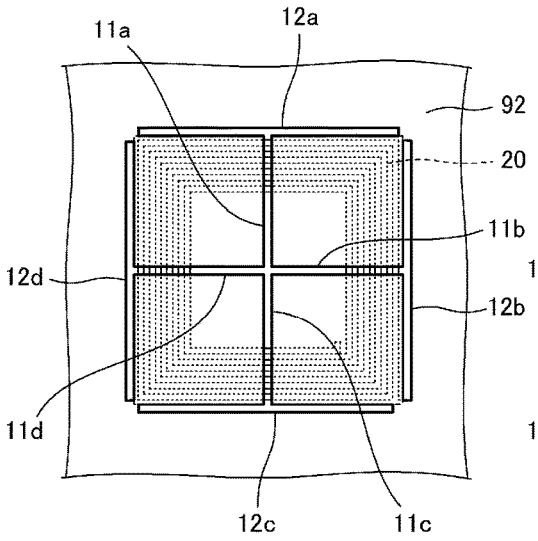
FIGS. 10A, 10B, 10C, and 10D are each a plan view of an antenna portion of a mobile communication terminal according to a fourth preferred embodiment of the present invention.

FIGS. 10A, 10B, 10C, and 10D are each a plan view of an antenna portion of a mobile communication terminal according to the fourth preferred embodiment. The lengths of the second slit patterns 12*a*, 12*b*, 12*c*, and 12*d* of the antenna portion shown in FIG. 10A are twice the lengths of the second slit patterns 12*a*, 12*b*, 12*c*, and 12*d* of the slit formation portion 10 shown in the first preferred embodiment, and are equal or substantially equal to the external dimensions of the coil pattern 20.

Figure 10B:
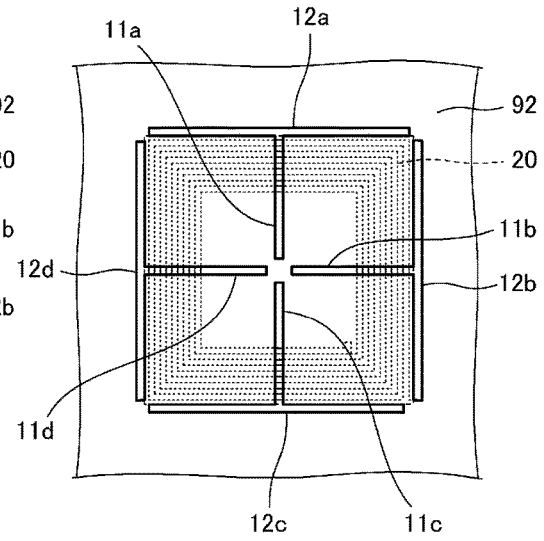
Figure 10C:
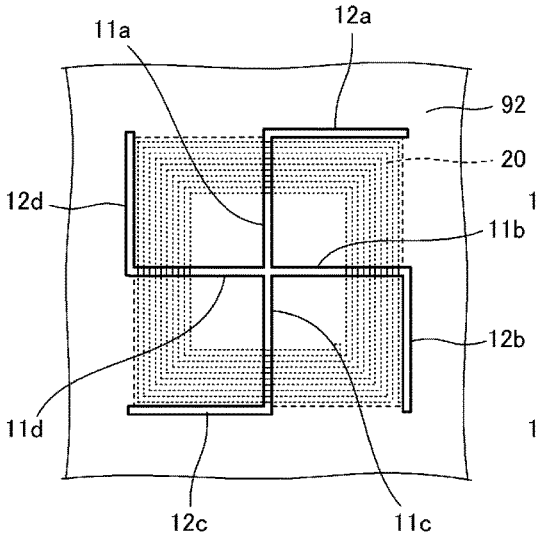
Figure 10D:
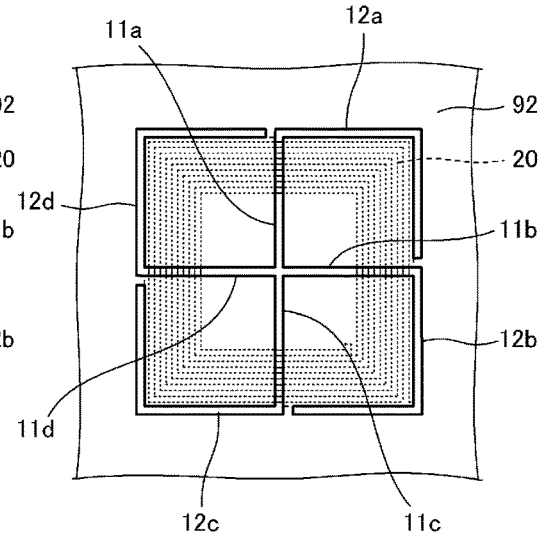

FIG. 10B shows an example where the first slit patterns 11*a*, 11*b*, 11*c*, and 11*d* are separated from each other in the example shown in FIG. 10A. FIG. 10C shows an example where the dimensions of the second slit patterns 12*a*, 12*b*, 12*c*, and 12*d* are made half and ends thereof are connected to the first slit patterns 11*a*, 11*b*, 11*c*, and 11*d*, respectively. FIG. 10D shows an example where from the example shown in FIG. 10C, the second slit patterns 12*a*, 12*b*, 12*c*, and 12*d* are extended along the outer periphery of the coil pattern 20.

Figure 11:
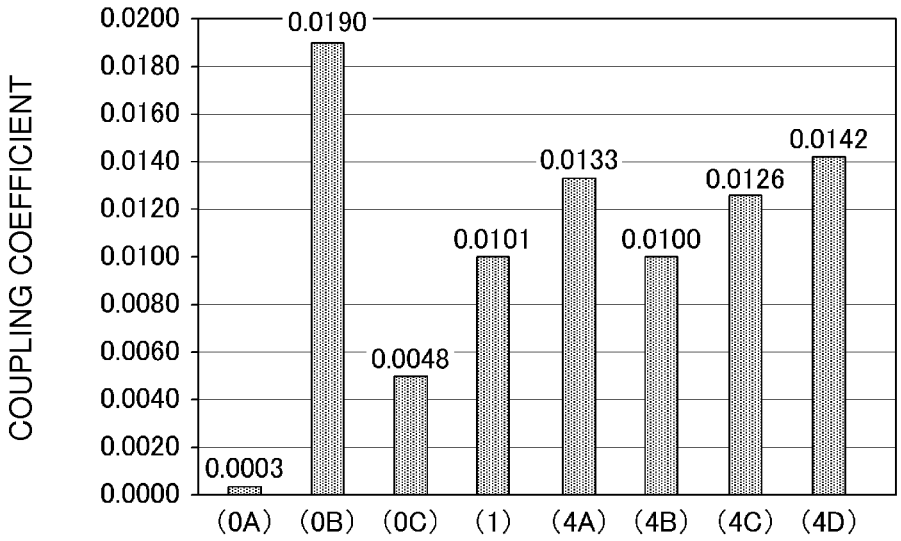
FIG. 11 is a diagram showing characteristics of the antenna portions of the fourth preferred embodiment of the present invention shown in FIGS. 10A, 10B, 10C, and 10D and the antenna portions of the comparative examples shown in FIGS. 4A, 4B, and 4C.

FIG. 11 is a diagram showing characteristics of the antenna portions of the fourth preferred embodiment shown in FIGS. 10A, 10B, 10C, and 10D and the antenna portions of the comparative examples shown in FIGS. 4A, 4B, and 4C. In FIG. 11, the vertical axis indicates a coupling coefficient with the antenna at the communication counterpart side. The conditions for measurement are the same as shown in the first preferred embodiment.

In FIG. 11, (0A), (0B), and (0C) are the characteristics of the respective antenna portions shown in FIGS. 4A, 4B, and 4C, and (1) is the characteristics of the antenna portion shown in the first preferred embodiment. In FIG. 11, (4A), (4B), (4C), and (4D) are the characteristics of the antenna portions of the fourth preferred embodiment shown in FIGS. 10A, 10B, 10C, and 10D.

When the second slit patterns are made long as shown in FIG. 10A, a coupling coefficient of about 0.0133 which is high is obtained. In addition, when the first slit patterns 11*a*, 11*b*, 11*c*, and 11*d* are separated from each other as shown in FIG. 10B, the effect of demarcating eddy currents diminishes, and thus the coupling coefficient decreases to some extent although the second slit patterns are long. Moreover, even if the dimensions of the second slit patterns 12*a*, 12*b*, 12*c*, and 12*d* are short as shown in FIG. 10C, when the ends thereof are connected to the first slit patterns 11*a*, 11*b*, 11*c*, and 11*d*, respectively, a coupling coefficient of about 0.0126 which is high is obtained. Furthermore, when the second slit patterns are extended so as to surround the coil pattern 20 as shown in FIG. 10D, a coupling coefficient of about 0.0142 which is high is obtained.

Fifth Preferred Embodiment

In a fifth preferred embodiment of the present invention, an example where the coil pattern of the planar coil antenna has a shape other than a rectangular or substantially rectangular shape will be described.

Figure 12A:
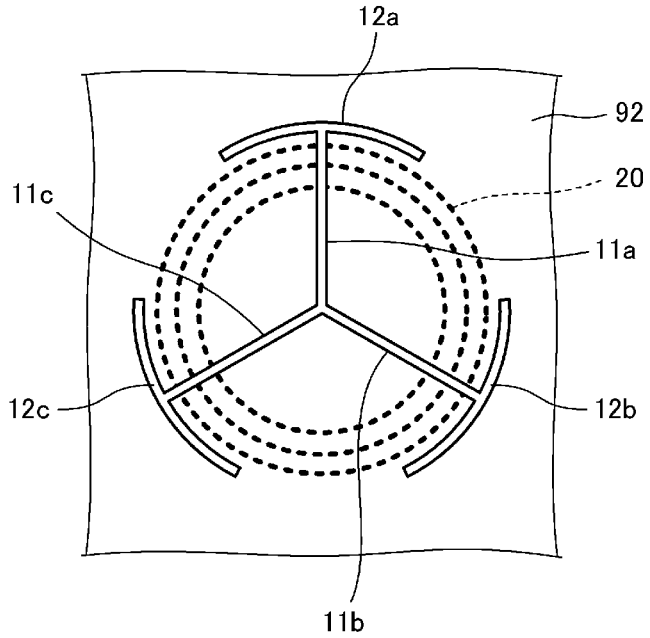
FIGS. 12A and 12B are each a plan view of an antenna portion of a mobile communication terminal according to a fifth preferred embodiment of the present invention.
Figure 12B:
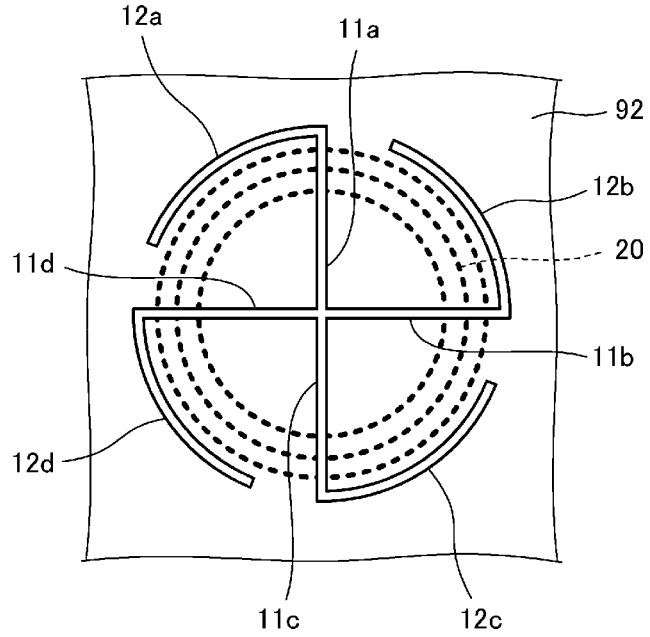

FIGS. 12A and 12B are each a plan view of an antenna portion of a mobile communication terminal according to the fifth preferred embodiment. In either example, the coil pattern 20 of the planar coil antenna is a pattern entirely having a circular spiral shape or substantially circular spiral shape. The coil pattern 20 is simplified and shown.

In the example shown in FIG. 12A, the slit formation portion includes first slit patterns 11*a*, 11*b*, and 11*c* which extend radially at equal angles of 120°, and arc-shaped second slit patterns 12*a*, 12*b*, and 12*c*. The first slit patterns 11*a*, 11*b*, and 11*c* intersect the coil pattern 20, and the second slit patterns 12*a*, 12*b*, and 12*c* extend along the outer periphery of the coil pattern 20.

In the example shown in FIG. 12B, the slit formation portion includes first slit patterns 11*a*, 11*b*, 11*c*, and 11*d* which extend radially at equal angles of 90°, and arc-shaped second slit patterns 12*a*, 12*b*, 12*c*, and 12*d*. The first slit patterns 11*a*, 11*b*, 11*c*, and 11*d* intersect the coil pattern 20, and the second slit patterns 12*a*, 12*b*, 12*c*, and 12*d* extend along the outer periphery of the coil pattern 20.

As described above, in the case where the coil pattern of the planar coil antenna is circular or substantially circular, the second slit patterns may have an arc shape. In addition, even in the case where the number of the first slit patterns is five or more, the first slit patterns are preferably patterns extending radially at equal angles or substantially equal angles.

Sixth Preferred Embodiment

In a sixth preferred embodiment of the present invention, another shape of the first slit patterns and the second slit patterns will be described.

Figure 13:
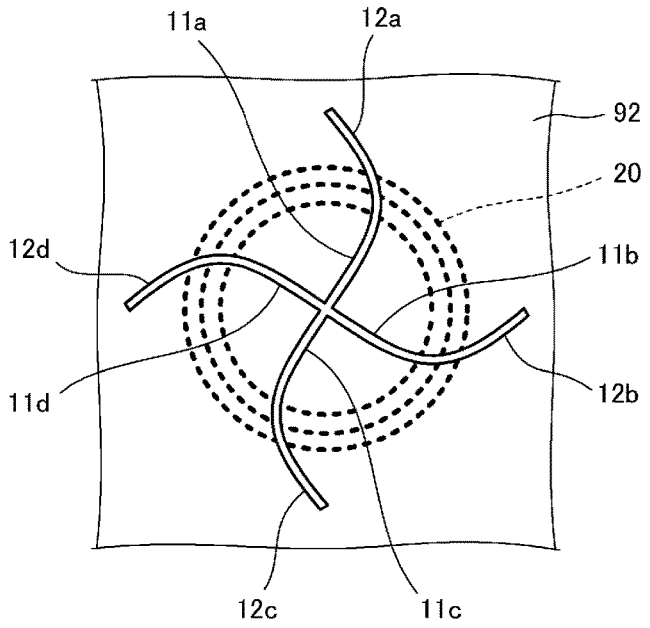
FIG. 13 is a plan view of an antenna portion of a mobile communication terminal according to a sixth preferred embodiment of the present invention.

FIG. 13 is a plan view of an antenna portion of a mobile communication terminal according to the sixth preferred embodiment. The slit formation portion includes first slit patterns 11*a*, 11*b*, 11*c*, and 11*d* and second slit patterns 12*a*, 12*b*, 12*c*, and 12*d*. The connection portions between the first slit patterns 11*a*, 11*b*, 11*c*, and 11*d* and the second slit patterns 12*a*, 12*b*, 12*c*, and 12*d* are curved. The portions that extend along the outer periphery of the coil pattern 20 at the outer side of the coil pattern 20 are the second slit patterns 12*a*, 12*b*, 12*c*, and 12*d*. In the example shown in FIG. 13, the second slit patterns 12*a*, 12*b*, 12*c*, and 12*d* increase the distance from the coil pattern 20 toward distal ends thereof.

As shown, the first slit patterns 11*a*, 11*b*, 11*c*, and 11*d* may obliquely intersect the coil pattern 20. In addition, the second slit patterns 12*a*, 12*b*, 12*c*, and 12*d* may be patterns tilted from the radial direction or may have a spiral shape.

Seventh Preferred Embodiment

In a seventh preferred embodiment of the present invention, another example of the slit formation portion and an example of another shape of the coil pattern will be described.

Figure 14:
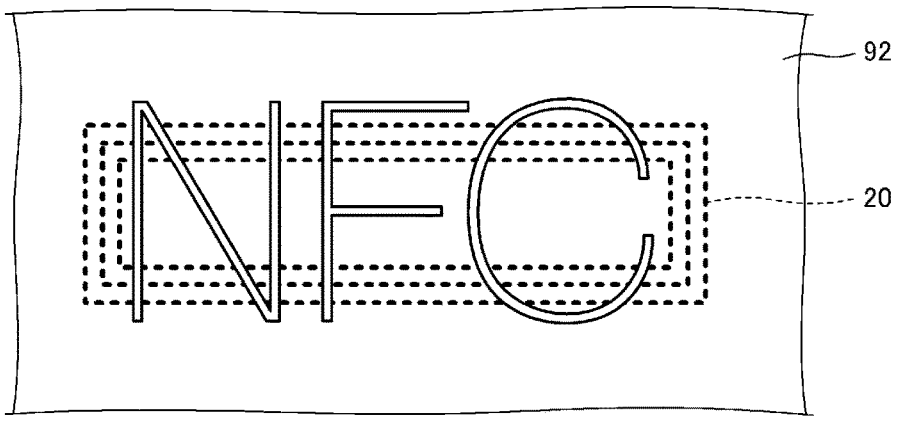
FIG. 14 is a plan view of an antenna portion of a mobile communication terminal according to a seventh preferred embodiment of the present invention.

FIG. 14 is a plan view of an antenna portion of a mobile communication terminal according to the seventh preferred embodiment. The slit formation portion includes a character pattern which is "NFC" and defined by slits. The general shape of the coil pattern 20 of the planar coil antenna is a rectangle or approximate rectangle. The coil pattern 20 and the character pattern defined by the slits are located such that the character pattern defined by the slits overlaps the coil pattern 20.

Of the character pattern formed by the slits, portions that intersect the coil pattern and linearly extend are first slit patterns, and portions that extend along the outer periphery of the coil pattern 20 are second slit patterns. Various preferred embodiments of the present invention are similarly applicable to the case where a plurality of slits closed as described above are included.

Eighth Preferred Embodiment

Figure 15:
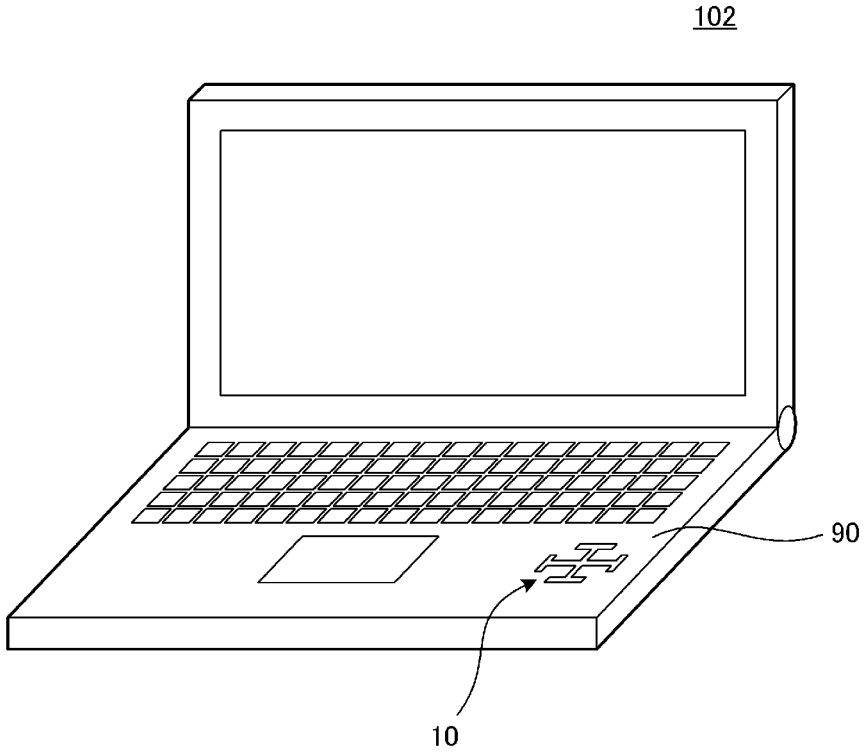
FIG. 15 is an external perspective view of a notebook computer as an example of a radio communication device according to an eighth preferred embodiment of the present invention.

In an eighth preferred embodiment of the present invention, another example of the radio communication device will be described. FIG. 15 is an external perspective view of a notebook computer as an example of a radio communication device according to an eighth preferred embodiment. The notebook computer 102 includes a metal casing 90, and a slit formation portion 10 is provided on an operation surface and particularly in a space lateral to a touch pad. At the slit formation portion 10, similarly to the preferred embodiments described above, a coil pattern of a planar coil antenna is disposed.

As shown, it is possible to use a portion of the operation surface of the notebook computer as a transmitting/receiving portion for NFC.

Other Preferred Embodiments

In each of the various preferred embodiments described above, the slit formation portion is preferably provided in the metal casing of the radio communication device. However, an insulating seal designed to cover the slit pattern may be attached to the slit formation portion.

In each of the various preferred embodiments described above, the slit formation portion is preferably provided in the metal casing as a body structural material which is an outer portion of the device, but the present invention is not limited thereto. For example, in the case where a metal chassis is included as a body structural material within a resin casing, a slit formation portion may be provided in the metal chassis.

In of the various preferred embodiments described above, the example where the number of the first slit patterns is at most four has been described, but the number of the first slit patterns may be more than four. In addition, the second slit patterns do not need to be connected to all the first slit patterns, respectively, and the second slit patterns may be connected to only some of the plurality of first slit patterns.

In of the various preferred embodiments described above, the example in which a slit having a slit width of about 0.1 mm is provided has been described, but in various preferred embodiments of the present invention, the "slit" preferably is a cut having a width which is equal to or smaller than about ⅕ of the inner shape width of the coil pattern. In order to ensure mechanical strength of the body structural material, the width of the slit is preferably equal to or smaller than about 1/10 of the inner shape width of the coil pattern. Moreover, in order to maintain the strength and shieldability of the metal casing, the total area of the slit is preferably smaller than the area of the coil opening 20A.

The antenna portion defined by the slit formation portion and the planar coil antenna as shown in each preferred embodiment described above may be used as an antenna for a tag when being applied to, for example, an RFID antenna. In addition, the antenna portion may also be used as an antenna for reader/writer.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A radio communication device comprising:

a body structural material defined by a metal plate;

a planar coil antenna disposed inside the body structural material so as to face the body structural material, the planar coil antenna including a coil pattern and a coil opening;

a plurality of first slit patterns provided in the body structural material and intersecting the coil pattern at least two locations on the coil pattern in a plan view, the first slit patterns not being directly or indirectly connected to any edge portion of the body structural material; and four of the first slit patterns are provided in a cross shape.

2. The radio communication device according to claim 1, wherein the first slit patterns pass through a center of the coil opening in a plan view.

3. The radio communication device according to claim 1, wherein the first slit patterns divide the coil opening in a plan view.

4. The radio communication device according to claim 1, further comprising a second slit pattern located along an outer edge of the coil pattern outside the coil pattern in a plan view, the second slit pattern being connected to the first slit patterns and not being connected to the any edge portion of the body structural material.

5. The radio communication device according to claim 4, wherein the body structural material includes an upper metal casing and a lower metal casing, and the first slit patterns and the second slit pattern are closed in a surface of the lower metal casing.

6. The radio communication device according to claim 4, wherein a slit width of the second slit pattern is less than or equal to about ⅕ of an inner diameter dimension of the coil pattern.

7. The radio communication device according to claim 4, wherein a slit width of the second slit pattern is less than or equal to about 1/10 of an inner diameter dimension of the coil pattern.

8. The radio communication device according to claim 4, wherein the second slit pattern is provided in plural and the second slit patterns surround the coil pattern.

9. The radio communication device according to claim 1, wherein the body structural material includes an upper metal casing and a lower metal casing.

10. The radio communication device according to claim 1, wherein the coil pattern is a rectangular or substantially rectangular spiral-shaped conductor pattern which is wound around the periphery of the coil opening.

11. The radio communication device according to claim 1, further comprising a power supply circuit and a parallel capacitor configured to perform resonant frequency adjustment and connected to both ends of the coil pattern.

12. The radio communication device according to claim 11, wherein a magnetic material layer is provided at a back side of the coil opening and the coil pattern.

13. The radio communication device according to claim 1, wherein a slit width of the first slit patterns is less than or equal to about ⅕ of an inner diameter dimension of the coil pattern.

14. The radio communication device according to claim 1, wherein a slit width of the first slit patterns is less than or equal to about 1/10 of an inner diameter dimension of the coil pattern.

15. The radio communication device according to claim 1, wherein three of the first slit patterns are provided in a T shape.

16. The radio communication device according to claim 1, wherein two of the first slit patterns are provided in an L-shape.

17. The radio communication device according to claim 1, wherein the coil pattern is a circular or substantially circular spiral-shaped conductor pattern which is wound around the periphery of the coil opening.

* * * * *